US011840396B2

(12) United States Patent
Iles

(10) Patent No.: US 11,840,396 B2
(45) Date of Patent: Dec. 12, 2023

(54) DOG WASTE BAG DISPENSER SYSTEM

(71) Applicant: Dog Gon Wild, Inc., Hampton, VA (US)

(72) Inventor: Roger W. Iles, Hampton, VA (US)

( * ) Notice: Subject to any disclaimer, the term of this patent is extended or adjusted under 35 U.S.C. 154(b) by 177 days.

(21) Appl. No.: 17/314,633

(22) Filed: May 7, 2021

(65) Prior Publication Data

US 2022/0356001 A1 Nov. 10, 2022

(51) Int. Cl.

| | |
|---|---|
| ***A47K 10/38*** | (2006.01) |
| ***A47K 10/42*** | (2006.01) |
| ***B65D 83/08*** | (2006.01) |
| ***A45F 5/02*** | (2006.01) |
| ***E01H 1/12*** | (2006.01) |
| ***B65F 1/00*** | (2006.01) |
| *A45F 5/00* | (2006.01) |

(52) U.S. Cl.

CPC ..... *B65D 83/08* (2013.01); *A45F 5/021* (2013.01); *B65F 1/0006* (2013.01); *E01H 1/1206* (2013.01); *A45F 2005/002* (2013.01); *A45F 2200/05* (2013.01); *B65F 2240/136* (2013.01)

(58) Field of Classification Search

CPC ..... A45F 5/021; A45F 2005/002; A45F 2200/05; B65D 83/08; B65F 1/0006; B65F 2240/136; B65H 2402/41; B65H 2402/413; B65H 2701/191; E01H 1/1206

See application file for complete search history.

(56) References Cited

U.S. PATENT DOCUMENTS

| | | | | |
|---|---|---|---|---|
| 1,069,757 | A * | 8/1913 | Hubbard et al. | A47K 10/38 242/598.2 |
| 4,848,690 | A * | 7/1989 | Lemoine | B65H 35/008 242/598.5 |
| 5,441,017 | A | 8/1995 | Lindsay | |
| 5,449,127 | A * | 9/1995 | Davis | A47K 10/38 242/598.6 |
| 6,012,605 | A * | 1/2000 | Miloscia | A47K 10/3827 242/588 |
| 6,076,717 | A | 6/2000 | Edwards et al. | |
| 6,240,881 | B1 * | 6/2001 | Edwards | A01K 27/006 119/795 |
| 6,267,322 | B1 * | 7/2001 | Harmathy | A47K 10/38 242/598.5 |
| 6,345,797 | B1 * | 2/2002 | Ming-Hsiao | A47K 10/40 248/309.2 |
| 6,364,156 | B1 * | 4/2002 | Smith | A47K 10/424 221/61 |
| 6,378,800 | B1 * | 4/2002 | Apichom | A47K 10/40 242/560 |
| 6,578,730 | B2 | 6/2003 | Trunsky | |

(Continued)

*Primary Examiner* — Gene O Crawford
*Assistant Examiner* — Kelvin L Randall, Jr.
(74) *Attorney, Agent, or Firm* — Olav M. Underdal; IDP Patent Services

(57) ABSTRACT

A dog waste bag dispenser device includes: a frame with a roll opening and an elongated opening, an axle assembly, a lower frame, and a bag clip with a slit; such that the waste bag dispenser device holds a dog waste bag roll, such that the dog waste bag dispenser device enables a user to easily remove a dog waste bag from the dog waste bag roll. The dog waste bag dispenser device also includes an attachment ring, which is configured to attach the dog waste bag dispenser device to an article of clothing or an object for easy portability.

17 Claims, 11 Drawing Sheets

(56) References Cited

U.S. PATENT DOCUMENTS

| | | | | |
|---|---|---|---|---|
| 6,945,493 | B1 * | 9/2005 | Gottesman | A47K 10/38 242/594.5 |
| 7,350,742 | B1 * | 4/2008 | Mariano | A47K 10/38 242/598.5 |
| 7,931,170 | B2 | 4/2011 | Che | |
| 8,113,381 | B2 | 2/2012 | Che | |
| 8,496,134 | B2 | 7/2013 | Springer et al. | |
| D778,083 | S | 2/2017 | Abbott | |
| 9,926,128 | B1 | 3/2018 | Logan et al. | |
| 10,202,255 | B2 * | 2/2019 | Sabol | B65H 75/08 |
| 2002/0175197 | A1 | 11/2002 | Cummins | |
| 2002/0185513 | A1 * | 12/2002 | Morris | B65H 35/10 225/96 |
| 2005/0263087 | A1 | 12/2005 | Livingston | |
| 2008/0017121 | A1 | 1/2008 | Mauro | |
| 2014/0361064 | A1 * | 12/2014 | Tan | B65H 35/10 225/106 |
| 2015/0001332 | A1 | 1/2015 | Qin | |
| 2015/0028149 | A1 * | 1/2015 | Szymaszek | B65H 16/005 242/598 |
| 2015/0337510 | A1 | 11/2015 | Feddock | |
| 2017/0215385 | A1 | 8/2017 | Hansen et al. | |
| 2019/0023487 | A1 | 1/2019 | Lu | |
| 2020/0024101 | A1 * | 1/2020 | Brereton | B65H 75/185 |
| 2020/0045937 | A1 * | 2/2020 | Weston | A01K 27/008 |
| 2020/0245594 | A1 | 8/2020 | Herriman | |
| 2020/0332485 | A1 | 10/2020 | Garland | |
| 2020/0346810 | A1 * | 11/2020 | Voo | B65B 67/085 |
| 2020/0352291 | A1 | 11/2020 | Feldman et al. | |
| 2021/0261379 | A1 * | 8/2021 | Yu | B65H 16/005 |

* cited by examiner

Dog Waste Bag Dispenser System

Dog Waste Bag Dispenser Device

DOG WASTE BAG DISPENSER SYSTEM

CROSS-REFERENCE TO RELATED APPLICATIONS

N/A.

FIELD OF THE INVENTION

The present invention relates generally to the field of dog waste collection, and more particularly to methods and systems for dog waste bag dispensing.

BACKGROUND OF THE INVENTION

When owning a dog, one of the most common struggles owners encounter is cleaning up after their dog when taking them on a walk. In order to collect their dog's excrement, owners must carry dog waste bag rolls with them on their walks. However, holding these rolls while also managing a leash can prove to be a difficult task. This difficulty is only exacerbated once the dog has defecated. Being able to locate a dog waste bag, free it from the roll, cleanly pick up the waste, find somewhere to store the full bag, and still manage the dog is a difficult sequence of tasks.

Dog waste bag holders are available, but are often difficult to carry and the end of the dog waste bag roll is not easy to locate and pull out. Thus, the process of bringing and locating a dog waste bag to clean up after one's dog is still a hectic experience, which dog owners struggle with daily.

As such, considering the foregoing, it may be appreciated that there continues to be a need for novel and improved devices and methods for dog waste bag dispensing.

SUMMARY OF THE INVENTION

The foregoing needs are met, to a great extent, by the present invention, wherein in aspects of this invention, enhancements are provided to the existing model of dog waste bag dispensers.

In an aspect, the dog waste bag dispenser device can include:

a) a frame; and b) an axle assembly, which can be configured to be laterally inserted through the main frame;

wherein the main frame and the axle assembly can be configured to receive a dog waste bag roll, which can include a plurality of dog waste bags, such that the dog waste bag dispenser device can be configured to enable a user to easily remove a dog waste bag from an outer end of the dog waste bag roll.

In a related aspect, the main frame can include:

a) a roll opening, which can be configured to receive the dog waste bag roll, such that the roll opening can be large enough to hold the dog waste bag roll at full capacity; and b) an elongated opening, which can be positioned below the roll opening, such that the outer end of the dog waste bag roll can be inserted through the elongated opening;

wherein the dog waste bags can be dispensed through the elongated opening, such that friction between the dog waste bags and the elongated opening can regulate speed of dispensing.

In another related aspect, the dog waste bag dispenser device can further include:

a) an attachment ring, which can be configured to attach the dog waste bag dispenser device to an article of clothing or an object, such that the user can easily carry the dog waste bag dispenser device when walking a dog.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
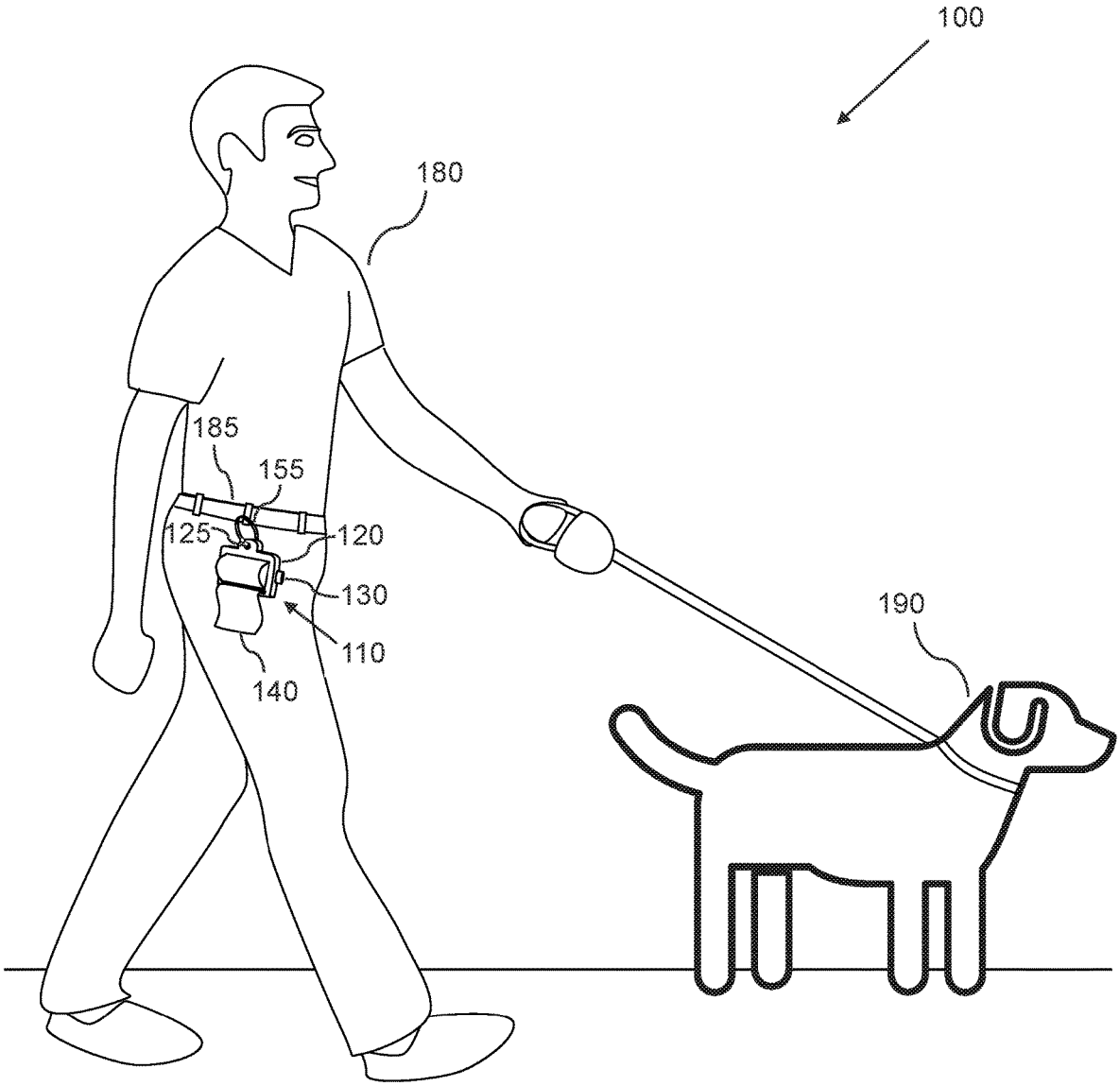
FIG. 1A is a perspective view of a dog waste bag dispenser system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a dog waste bag dispenser system 100, including a dog waste bag dispenser device 110 with reference to FIG. 1A, in such manner that like reference numerals refer to like components throughout; a convention that we shall employ for the remainder of this specification.

In an embodiment, as shown in FIG. 1A, a dog waste bag dispenser system 100 can include:

a) a dog waste bag roll 140; and b) a dog waste bag dispenser device 110, which can be configured to hold the dog waste bag roll 140, such that the dog waste bag dispenser device 110 can enable a user 180 to easily access an end of the dog waste bag roll 140, such that the user 180 can easily remove a dog waste bag from the dog waste bag roll 140.

Figure 1B:
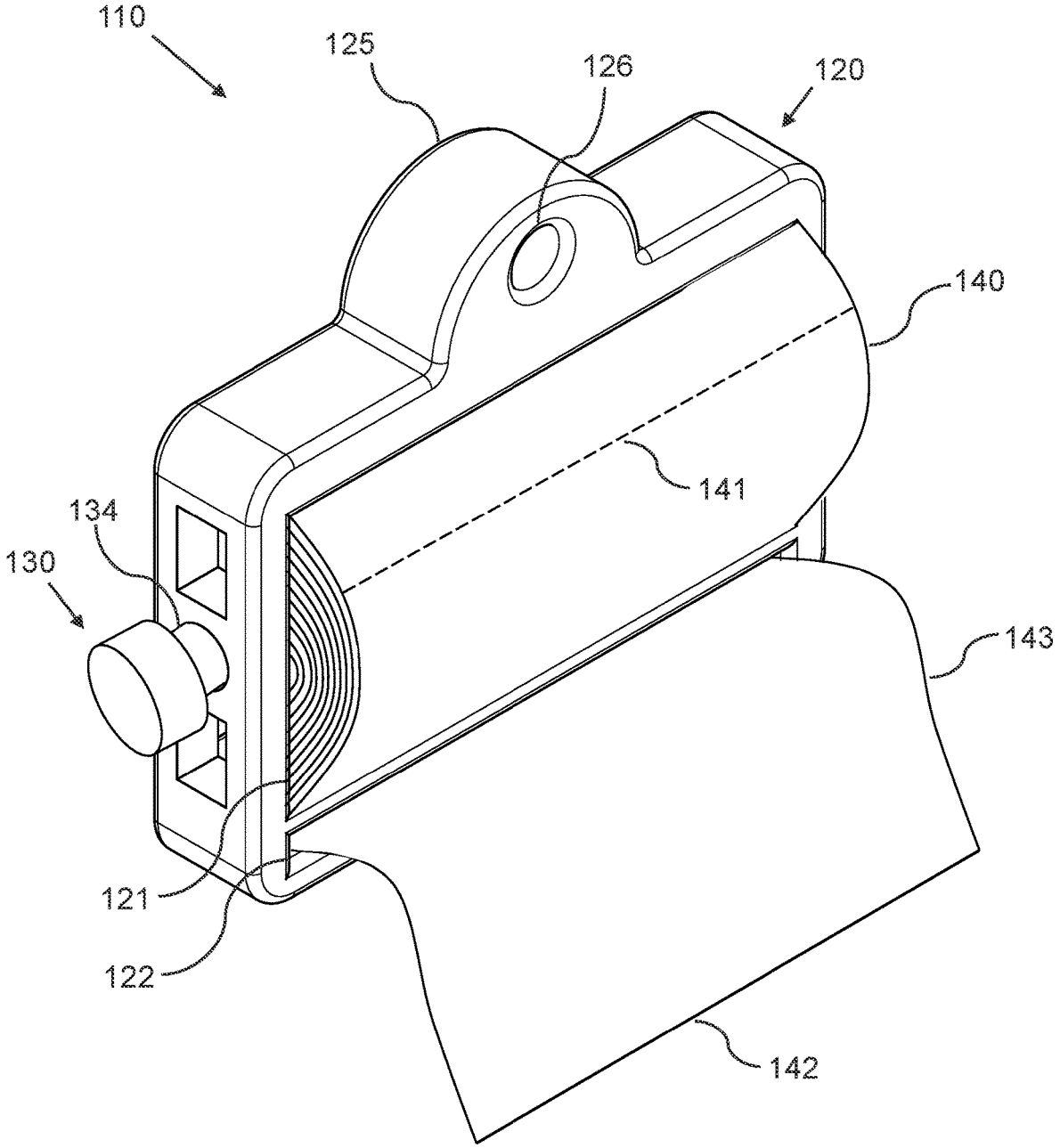
FIG. 1B is a perspective view of a dog waste bag dispenser device, according to an embodiment of the invention.
Figure 2A:
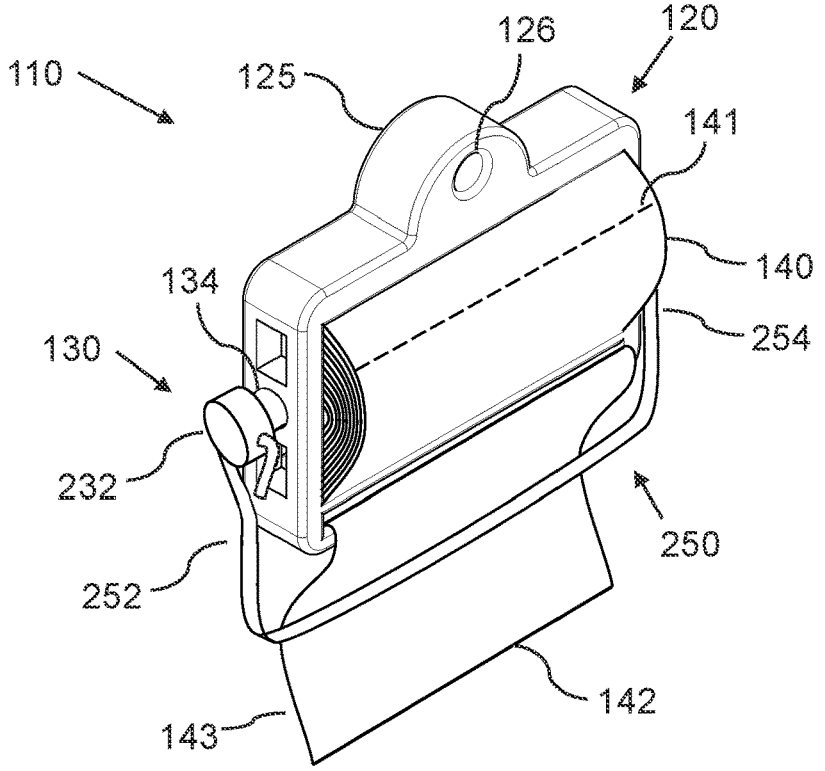
FIG. 2A is a front perspective view of a dog waste bag dispenser device with a lower frame, according to an embodiment of the invention.
Figure 2B:
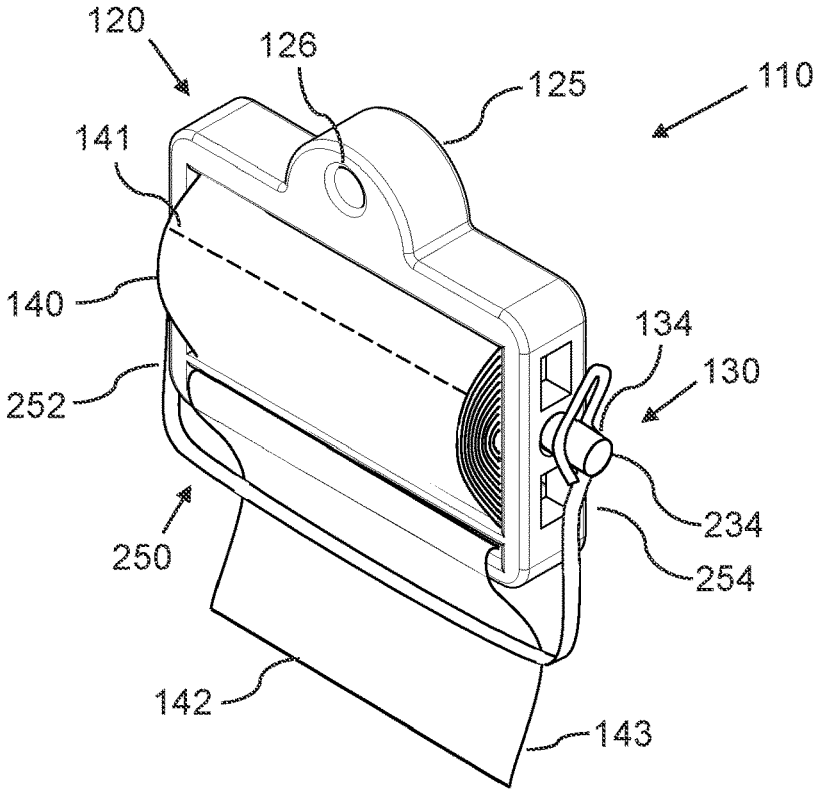
FIG. 2B is a rear perspective view of a dog waste bag dispenser system with a lower frame, according to an embodiment of the invention.

In a related embodiment, as shown in FIGS. 1A and 1B, the dog waste bag dispenser device 110 can include:

a) a main frame 120; and b) an axle assembly 130, which can be configured to be laterally inserted through the main frame 120;

wherein the main frame 120 and the axle assembly 130 can be configured to receive a dog waste bag roll 140, which can include a plurality of dog waste bags 143, such that the dog waste bag dispenser device 110 can be configured to enable a user 180 to easily remove a dog waste bag 143 from an outer end 142 of the dog waste bag roll 140.

In a related embodiment, as shown in FIG. 1B, the dog waste bag roll 140 can include a plurality of dog waste bags 143 that are be connected in a long, rolled up strip, such that each dog waste bag 143 in the plurality of dog waste bags 143 can be connected to another through a perforated edge 141, such that the dog waste bag 143 at the outer end 142 of the dog waste bag roll 140 can be easily removed from the dog waste bag roll 140.

In a further related embodiment, as shown in FIGS. 3A, 3B, 4A, 4B, 4C, and 4D, the main frame 120 can include:

a) a roll opening 121, which can be configured to receive the dog waste bag roll 140, such that the roll opening 121 can be large enough to hold the dog waste bag roll 140 at full capacity; and b) an elongated opening 122, which can be positioned below the roll opening 121, such that the outer end 142 of the dog waste bag roll 140 can be inserted through the elongated opening 122;

wherein the dog waste bags 143 can be dispensed through the elongated opening 122, such that friction between the dog waste bags 143 and the elongated opening 122 can regulate a speed of dispensing.

Figure 3A:
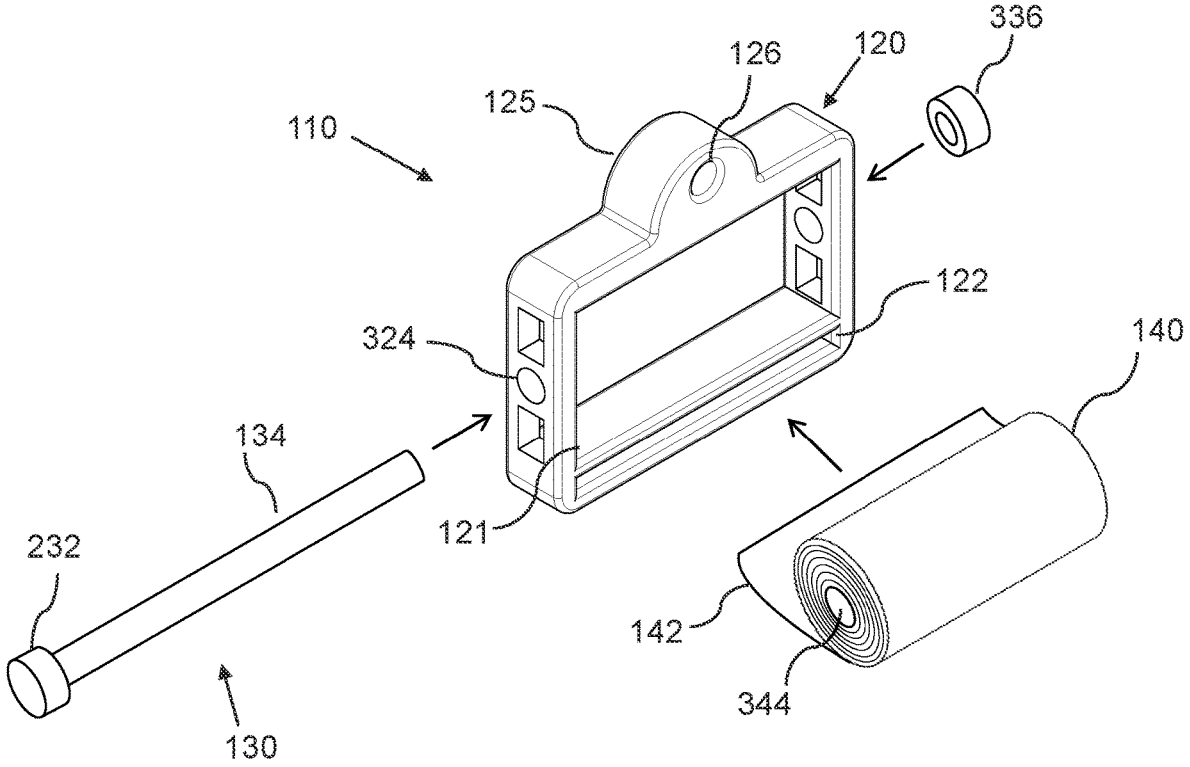
FIG. 3A is a perspective view illustrating the assembly of a dog waste bag dispenser device, according to an embodiment of the invention.
Figure 5A:
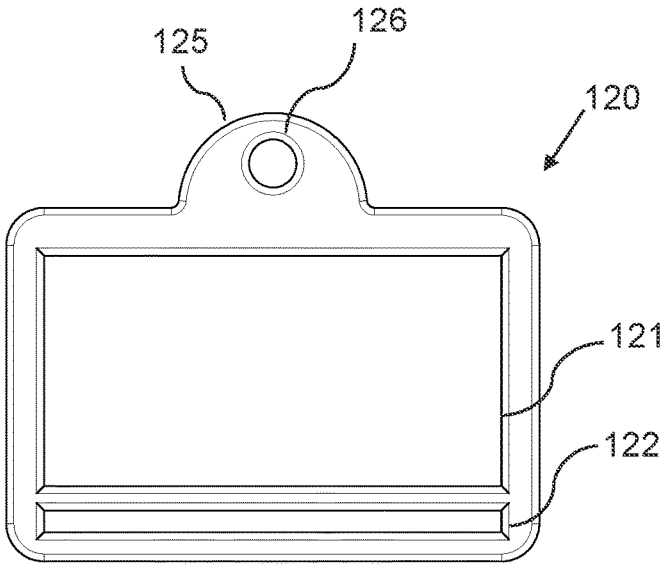
FIG. 5A is a front view of a frame, according to an embodiment of the invention.
Figure 5B:
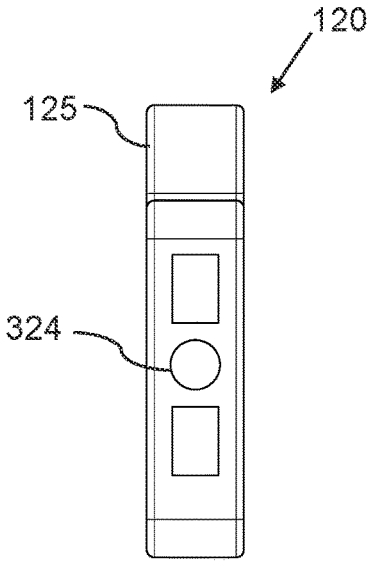
FIG. 5B is a side view of a frame, according to an embodiment of the invention.
Figure 5C:
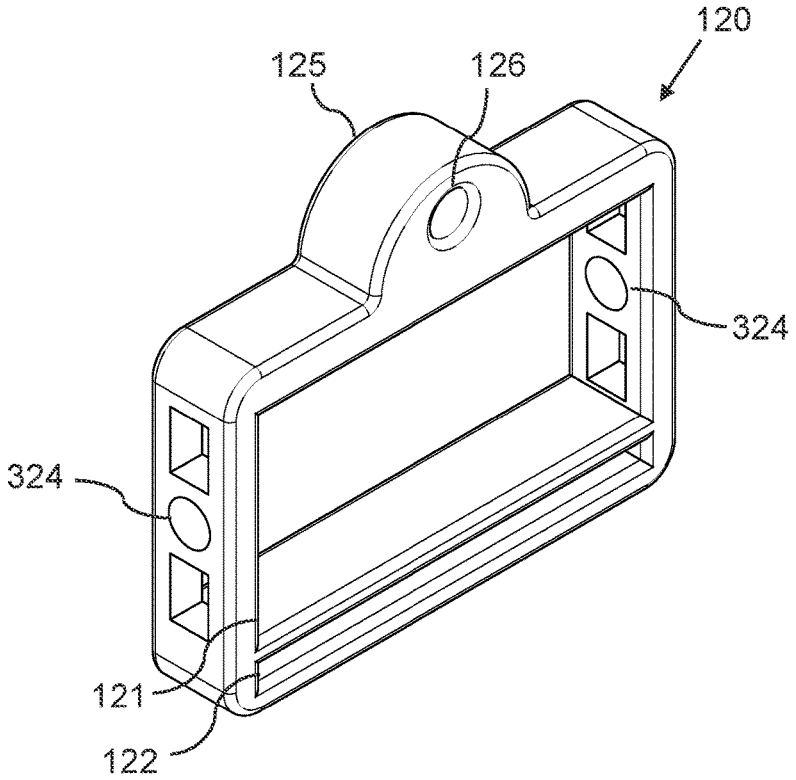
FIG. 5C is a perspective view of a frame, according to an embodiment of the invention.

In another related embodiment, as shown in FIGS. 3A, 5B, and 5C, the main frame 120 can further include:

a) at least one axle hole 324, which can protrude laterally through the main frame 120, such that the at least one axle hole 324 can be configured to receive the axle assembly 130;

wherein the at least one axle hole 324 can be configured to align with an axial roll aperture 344 of the dog waste bag roll 140 when the dog waste bag roll 140 is mounted into the main frame 120.

Figure 3B:
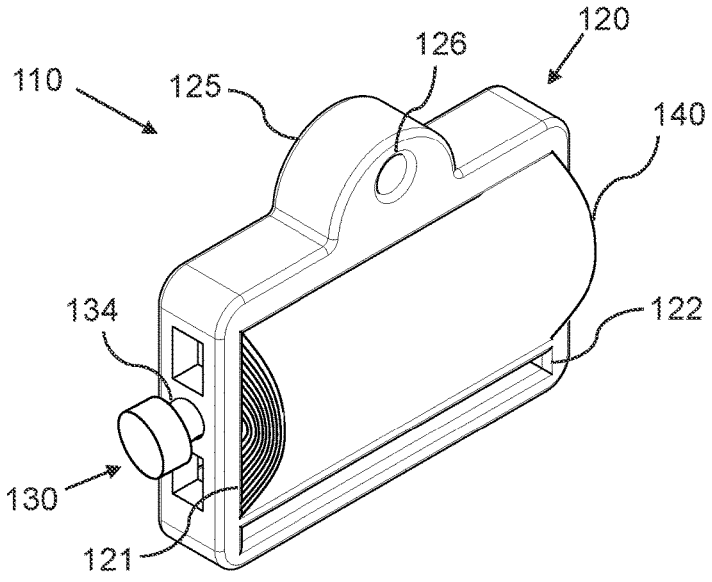
FIG. 3B is a perspective view of an assembled dog waste bag dispenser device, according to an embodiment of the invention.
Figure 4A:
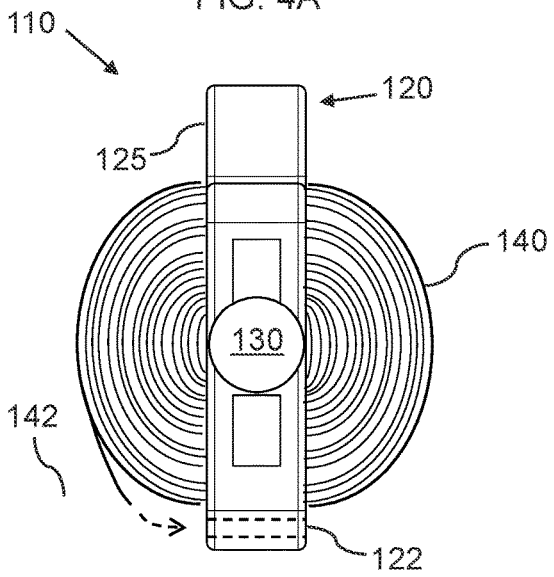
FIG. 4A is a side view illustrating the insertion of an end of a dog waste bag roll into an elongated opening of a dog waste bag dispenser device, according to an embodiment of the invention.
Figure 4B:
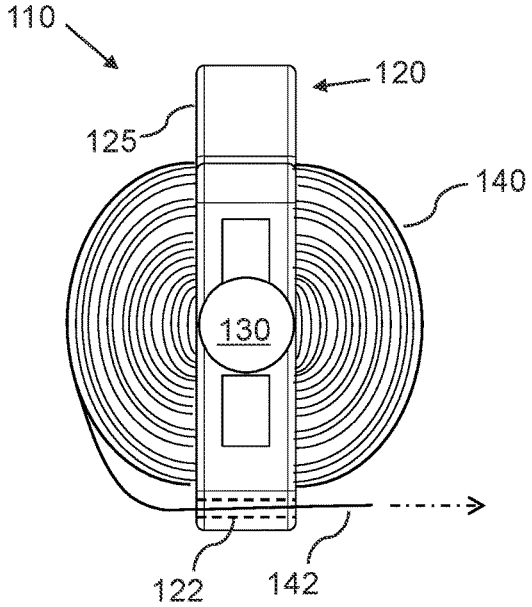
FIG. 4B is a side view illustrating the insertion of an end of a dog waste bag roll into an elongated opening of a dog waste bag dispenser device, according to an embodiment of the invention.
Figure 4C:
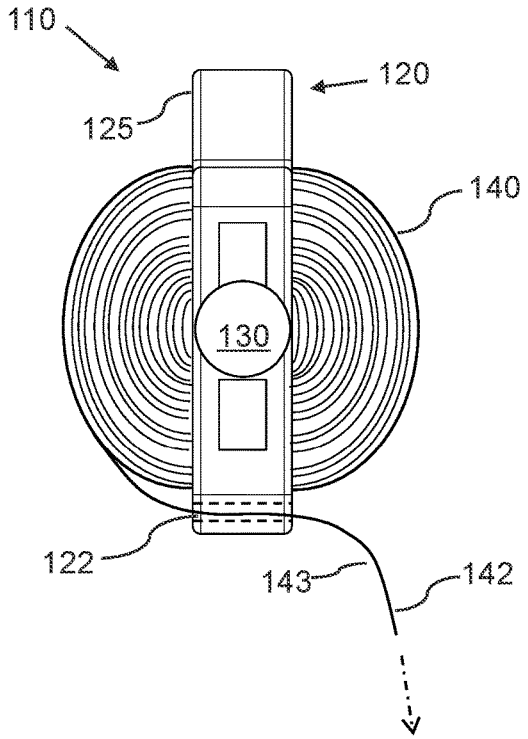
FIG. 4C is a side view illustrating the insertion of an end of a dog waste bag roll into an elongated opening of a dog waste bag dispenser device, according to an embodiment of the invention.
Figure 4D:
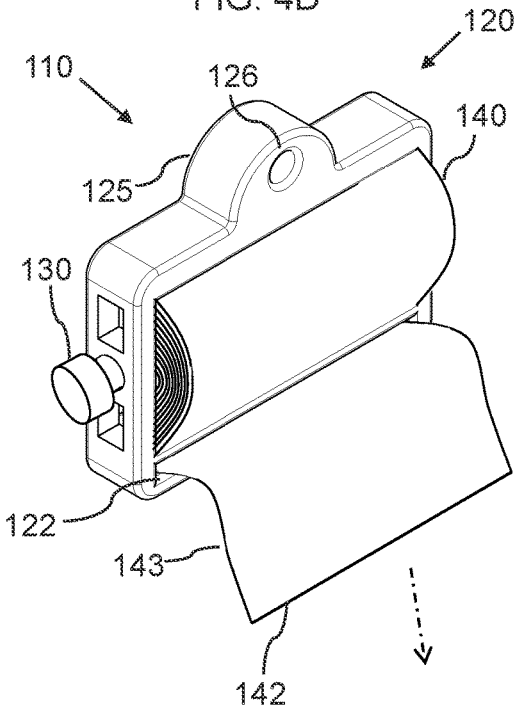
FIG. 4D is a perspective view illustrating an inserted end of a dog waste bag roll into an elongated opening of a dog waste bag dispenser device, according to an embodiment of the invention.

In yet another related embodiment, as shown in FIGS. 3A and 3B, the axle assembly 130 can include:

a) a main axle 134, such that the main axle 134 can be inserted through the at least one axle hole 324, and such that the main axle 134 can be configured to be inserted through the axial roll aperture 344 of the dog waste bag roll 140, when the dog waste bag roll 140 is mounted into the main frame 120, such that the main axle 134 can rotatably attach the dog waste bag roll 140 to the main frame 120; and b) an end head 232, which is connected to a first end of the main axle 134, wherein the end head 232 is wider than the at least one axle hole 324 to hold the first end of the main axle 134 in place on a first side of the main frame 120;

c) a locking mechanism 336, which can be configured to lock onto a second end of the main axle 134 on an outer side of the main frame 120, such that the locking mechanism 336 can prevent the axle assembly 130 from sliding laterally out of the at least one axle hole 324.

In a related embodiment, as shown in FIGS. 3A and 3B, the locking mechanism 336 can be configured as a nut that screws or snaps onto the main axle 134, or as a pin that can be inserted through a pin hole.

In a further related embodiment, as shown in FIGS. 2A, 2B, 6F, 6G, and 6H, the axle assembly 130 can further include:

a) a lower frame 250, wherein a first end 252 of the lower frame 250 can be pivotably connected 602 to an end head 232 on a first end of the main axle 134, such that a second end 254 of the lower frame 250 can be configured to detachably connect to a second end 234 of the main axle 134, wherein the second end 254 of the lower frame 250 can act as the locking mechanism 336;

wherein a lower portion of the lower frame 250 can be substantially u-shaped, such that the lower portion of the lower frame 250 can protrude below the main frame 120 (via rotation of the main axle 134), such that the outer end 142 of the dog waste bag roll 140 can be tucked (i.e. is tuckable) behind the lower portion of the lower frame 250. As shown, the lower frame 250 can be made from a single piece of metal wire.

In a related embodiment, as shown in FIG. 1A, the dog waste bag dispenser device 110 can further include:

a) an attachment ring 155, which is connected to the main frame 120, such that the attachment ring 155 can be configured as a carabiner clip or a key ring, such that the attachment ring 155 can be configured to attach the dog waste bag dispenser device 110 to an article of clothing or an object 185, such that the user 180 can easily carry the dog waste bag dispenser device 110 when walking a dog 190.

In another related embodiment, as shown in FIGS. 1A and 1B, the main frame 120 can further include:

a) an attachment structure 125, which can protrude from an upper surface of the main frame 120, such that the attachment structure 125 can include an attachment aperture 126, which can protrude through the attachment structure 125;

wherein an attachment ring 155 can be inserted through the attachment aperture 126.

Figure 6A:
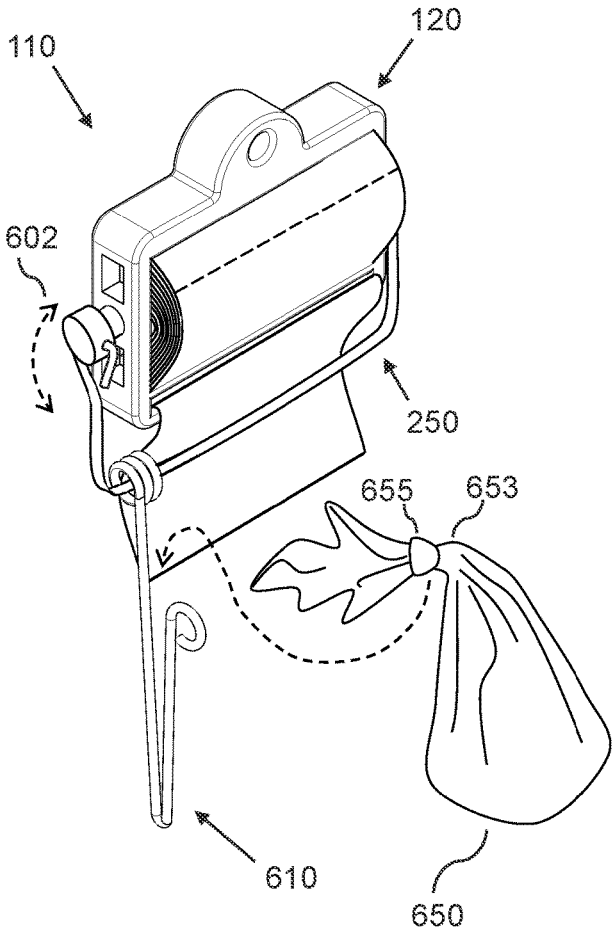
FIG. 6A is a perspective view of a dog waste bag dispenser device with an attached bag clip, according to an embodiment of the invention.
Figure 6B:
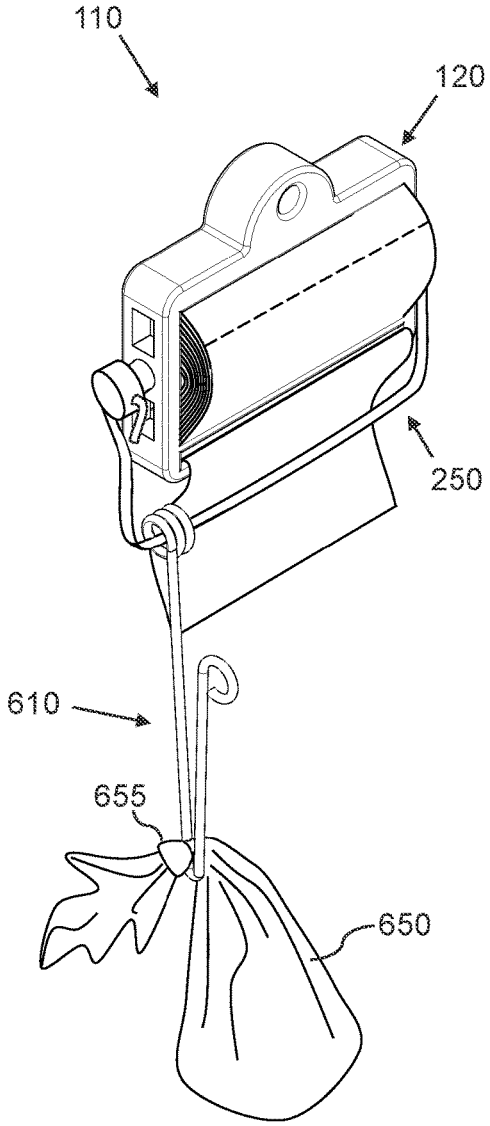
FIG. 6B is a perspective view of a dog waste bag dispenser device with an attached bag clip in use, according to an embodiment of the invention.
Figure 6C:
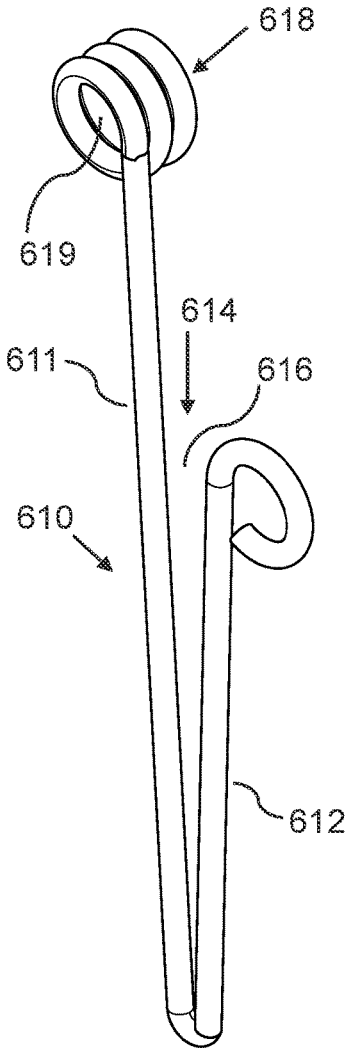
FIG. 6C is a perspective view of a bag clip, according to an embodiment of the invention.
Figure 6D:
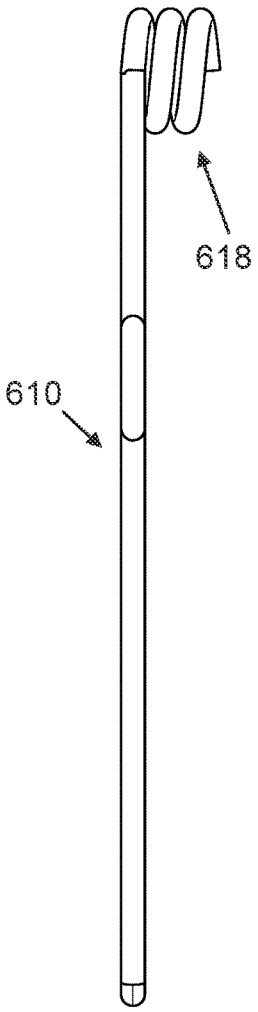
FIG. 6D is a front view of a bag clip, according to an embodiment of the invention.
Figure 6E:
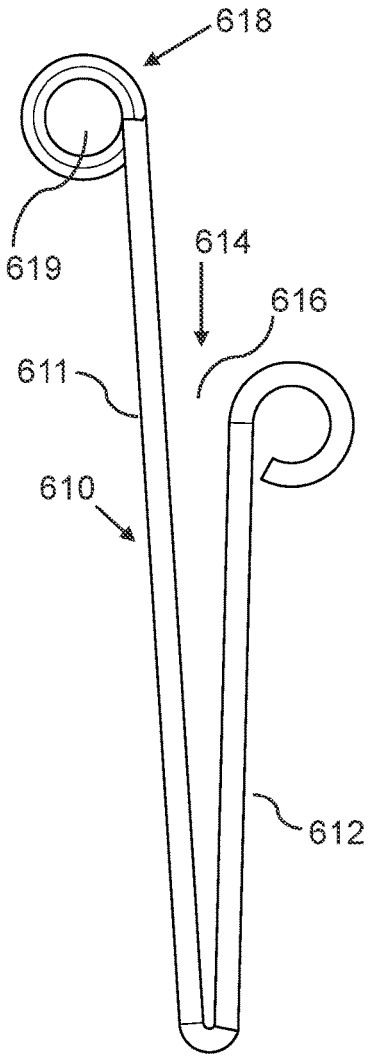
FIG. 6E is a side view of a bag clip, according to an embodiment of the invention.
Figure 6F:
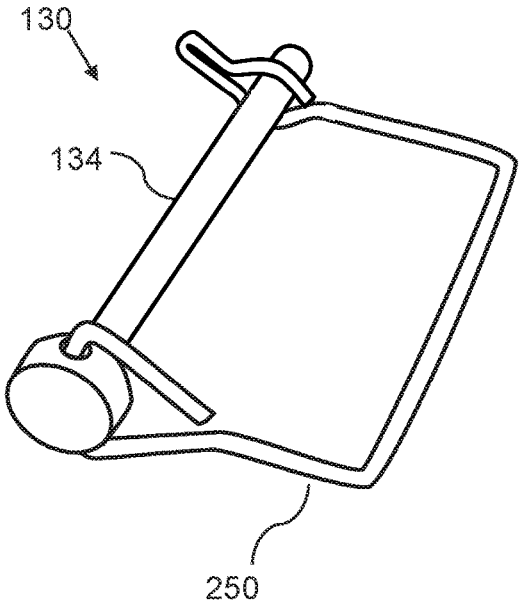
FIG. 6F is a left perspective view of an axle assembly with an attached lower frame, according to an embodiment of the invention.
Figure 6G:
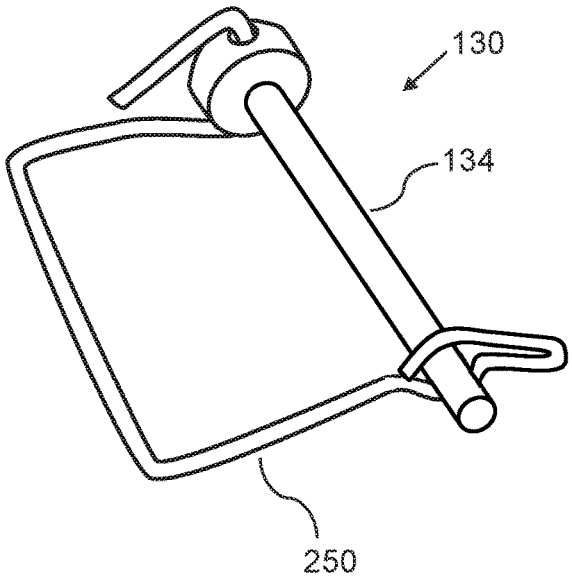
FIG. 6G is a right perspective view of an axle assembly with an closed lower frame, according to an embodiment of the invention.
Figure 6H:
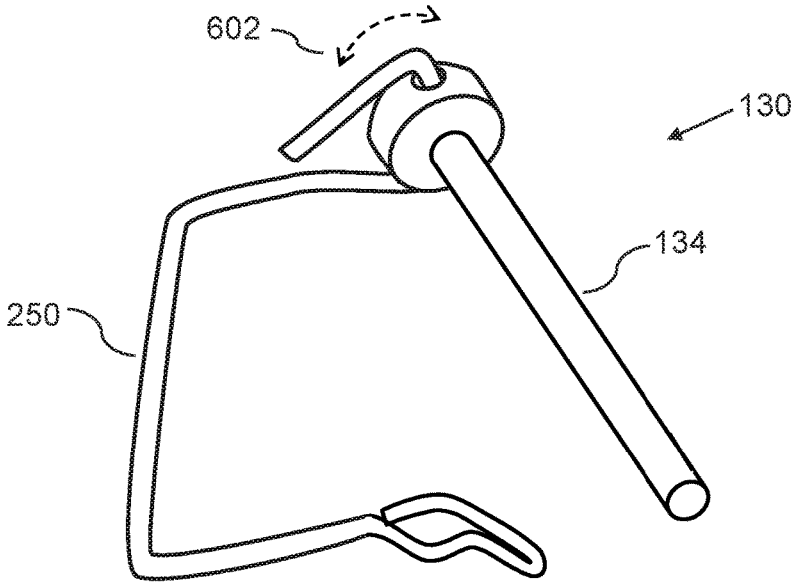
FIG. 6H is a right perspective view of an axle assembly with an opened lower frame, according to an embodiment of the invention.
Figure 7:
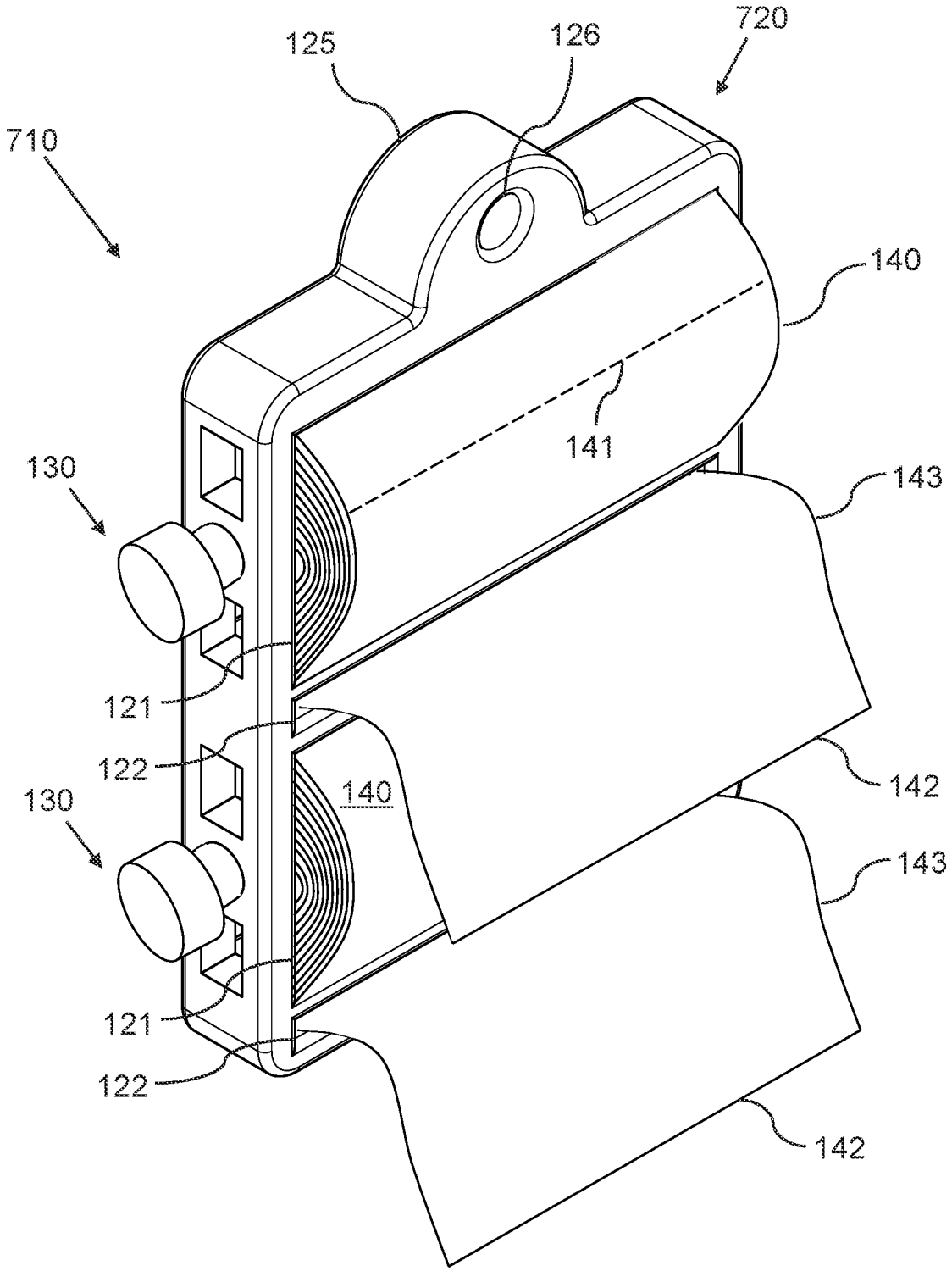
FIG. 7 is a perspective view of a double dog waste bag dispenser, according to an embodiment of the invention.
Figure 8A:
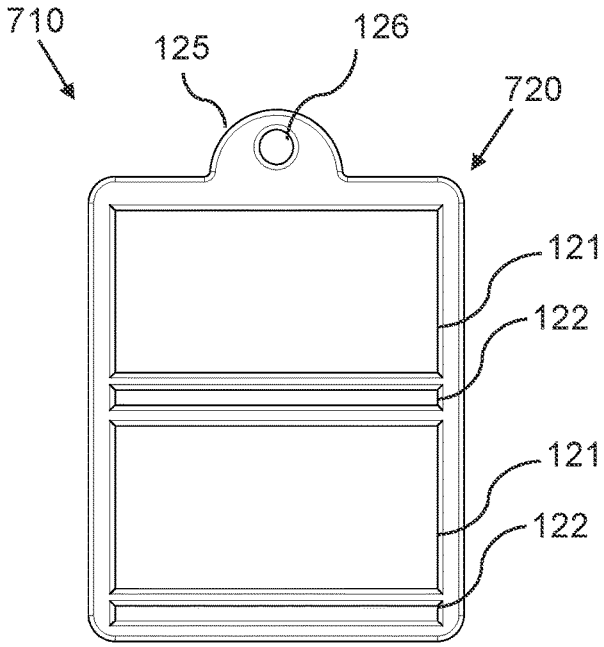
FIG. 8A is a front view of a double dog waste bag frame, according to an embodiment of the invention.
Figure 8B:
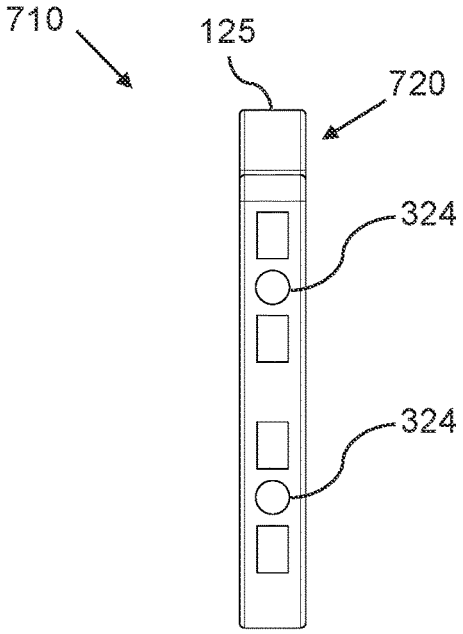
FIG. 8B is a side view of a double dog waste bag frame, according to an embodiment of the invention.
Figure 8C:
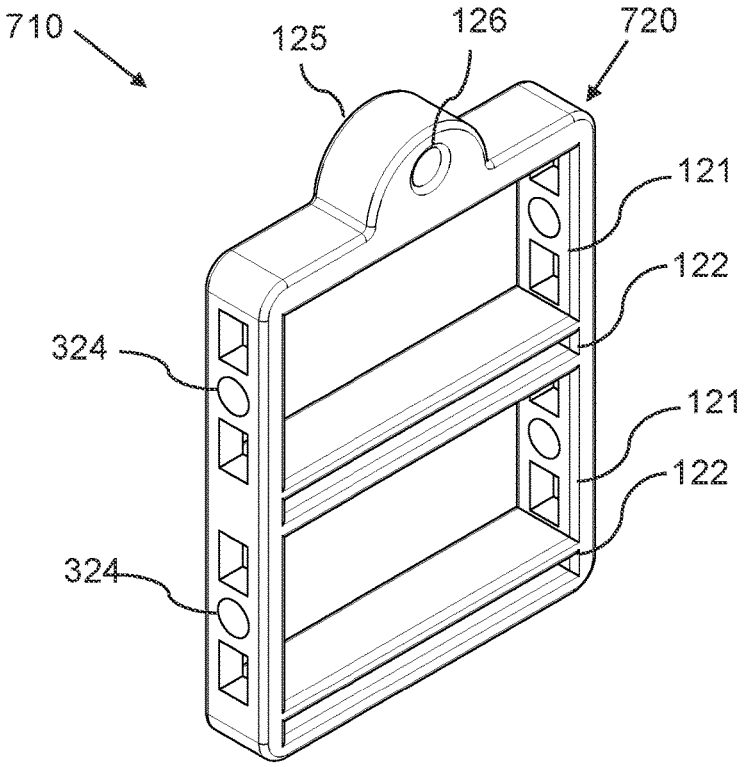
FIG. 8C is a perspective view of a double dog waste bag frame, according to an embodiment of the invention.

In yet another embodiment, as shown in FIGS. 6A and 6B, the dog waste bag dispenser device 110 can include:

a) a bag clip 610, which can be connected to main frame 120, for example via the lower frame 250 (i.e. connect to a lower portion of the main frame 120, either directly or via the lower frame 250), such that the bag clip 610 can include a slit 614, wherein the slit 614 is open in a top of the slit 614 and closed in a bottom of the slit 614;

wherein the slit 614 can be configured as a narrowing slit 614, which narrows from a wider top of the narrowing slit 614 to a narrow bottom of the narrowing slit 614;

such that an upper end 653 of a used dog waste bag 650 on an inner side of a top knotted end 655 of the used dog waste bag 650 can be insertable through an open entrance 616 of the narrowing slit 614, such that the used dog waste bag 650 can be slid down and securely positioned in a bottom of the narrowing slit 614, to hold the used dog waste bag 650 in place, as shown in FIG. 6B.

In a further related embodiment, as shown in FIGS. 6A, 6B, 6C, 6D, and 6E, a first end of the bag clip 610 can further include:

a) an upper connector 618, which can be connect to the lower frame 250 (or alternatively connect to a lower portion of the main frame 120).

In a yet further related embodiment, as shown in FIGS. 6A, 6B, 6C, 6D, and 6E, the bag clip 610 can be made from an elongated flexible member, such as a metal wire;

such that a first end of the bag clip 610 is configured as a spiral of the elongated flexible member, such that the upper connector 618 can slide onto the lower frame 250 with the lower frame protruding through a central aperture 619 of the spiral 618;

such that the narrowing slit 614 can be configured as a folded central portion of the elongated flexible member, wherein the central portion comprises a downward projecting portion 611 and an upward projecting portion 612.

In another yet further related embodiment, as shown in FIGS. 6A, 6B, 6C, 6D, and 6E, the bag clip 610 can be made from a metal wire;

such that a second (outer) end of the bag clip 610 is configured as a loop which loops back to proximity with the bag clip 610, in order to form a rounded outer end of the bag clip 610, to reduce any risk of injury or damage from contact with the second (outer) end of the bag clip 610.

In an alternative embodiment, as shown in FIGS. 7, 8A, 8B, and 8C, the dog waste bag dispenser device 110 can be configured as a double dog waste bag dispenser 710, such that the double dog waste bag dispenser 710 can hold two dog waste bag rolls 140, such that the double dog waste bag frame 720 can include two roll openings 121 and two elongated openings 122, such that the two elongated openings 122 are positioned beneath corresponding roll openings 121.

Thus, in related alternative embodiments, as shown in FIGS. 7, 8A, 8B, and 8C, the dog waste bag dispenser device 110 can include:

a second axle assembly, which is configured to be connected to the main frame;

wherein the main frame and the second axle assembly are configured to receive a second dog waste bag roll, which comprises a second plurality of dog waste bags, such that the dog waste bag dispenser device is configured to enable a user to easily remove a dog waste bag from an outer end of the second dog waste bag roll;

whereby the dog waste bag dispenser device is configured to receive two dog waste bag rolls.

Here has thus been described a multitude of embodiments of the dog waste bag dispenser device 110, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A dog waste bag dispenser device, comprising:

a) a main frame; and b) an axle assembly, which is configured to be laterally inserted through the main frame;

wherein the main frame and the axle assembly are configured to receive a dog waste bag roll, which comprises a plurality of dog waste bags, such that the dog waste bag dispenser device is configured to enable a user to easily remove a dog waste bag from an outer end of the dog waste bag roll;

wherein the main frame further comprises:

at least one axle hole, which protrudes laterally through the main frame, such that the at least one axle hole is configured to receive the axle assembly;

wherein the at least one axle hole is configured to align with an axial roll aperture of the dog waste bag roll when the dog waste bag roll is mounted into the main frame;

wherein the axle assembly further comprises:

a main axle, such that the main axle is inserted through the at least one axle hole, and such that the main axle is configured to be inserted through the axial roll aperture of the dog waste bag roll, when the dog waste bag roll is mounted into the main frame, such that the main axle rotatably attaches the dog waste bag roll to the main frame;

an end head, which is connected to a first end of the main axle, wherein the end head is wider than the at least one axle hole to hold the first end in place on a first side of the main frame;

a locking mechanism, which is configured to lock onto a second end of the main axle on a second side of the main frame, such that the locking mechanism prevents the axle assembly from laterally sliding out of the at least one axle hole: and a lower frame, which is connected to the main axle, such that a lower portion of the lower frame is configured to protrude below the main frame, such that the outer end of the dog waste bag roll is tuckable behind the lower frame wherein a first end of the lower frame is pivotably connected to a first outer end of the main axle, such that a second end of the lower frame is configured to detachably connect to a second outer end of the main axle, wherein the second end of the lower frame is configured as the locking mechanism.

2. The dog waste bag dispenser device of claim 1, wherein the main frame comprises:

a) a roll opening, which is configured to receive the dog waste bag roll; and b) an elongated opening, which is positioned below the roll opening, such that the outer end of the dog waste bag roll is insertable through the elongated opening;

such that the dog waste bags are dispensable through the elongated opening.

3. The dog waste bag dispenser device of claim 1, wherein the lower portion is u-shaped.

4. The dog waste bag dispenser device of claim 1, further comprising:

an attachment ring, which is connected to the main frame, such that the attachment ring is configured to attach the dog waste bag dispenser device to an article of clothing or object.

5. The dog waste bag dispenser device of claim 1, wherein the main frame further comprises:

an attachment structure, which protrudes from an upper surface of the main frame, such that the attachment structure comprises an attachment aperture, which protrudes through the attachment structure;

wherein the attachment ring is inserted through the attachment aperture.

6. The dog waste bag dispenser device of claim 1, further comprising:

a bag clip, which is connected to the main frame, such that the bag clip comprises a slit, which is open in a top of the slit and closed in a bottom of the slit;

such that an upper end of a used dog waste bag on an inner side of a top knotted end of the used dog waste bag is insertable through an open entrance of the slit, such that the used dog waste bag slides down and is securely positioned in a bottom of the slit.

7. The dog waste bag dispenser device of claim 6, wherein the slit is configured as a narrowing slit, which narrows from a top of the narrowing slit to a bottom of the narrowing slit.

8. A dog waste bag dispenser device, comprising:

a) a frame; and b) a first axle assembly, which is configured to be connected to the main frame;

wherein the main frame and the first axle assembly are configured to receive a first dog waste bag roll, which comprises a first plurality of dog waste bags, such that the dog waste bag dispenser device is configured to enable a user to easily remove a first dog waste bag from an outer end of the first dog waste bag roll;

wherein the main frame further comprises:

at least one axle hole, which protrudes laterally through the main frame, such that the at least one axle hole is configured to receive the first axle assembly;

wherein the at least one axle hole is configured to align with an axial roll aperture of the first dog waste bag roll when the first dog waste bag roll is mounted into the main frame;

wherein the first axle assembly further comprises:

a main axle, such that the main axle is inserted through the axle hole, and such that the main axle is configured to be inserted through the axial roll aperture of the first dog waste bag roll, when the first dog waste bag roll is mounted into the main frame, such that the main axle rotatably attaches the first dog waste bag roll to the main frame;

an end head, which is connected to a first end of the main axle, wherein the end head is wider than the at least one axle hole to hold the first end in place on a first side of the main frame;

a locking mechanism, which is configured to lock onto a second end of the main axle on a second side of the main frame, such that the locking mechanism prevents the axle assembly from laterally sliding out of the at least one axle hole; and a lower frame, which is connected to the main axle, such that a lower portion of the lower frame is configured to protrude below the main frame, such that the outer end of the dog waste bag roll is tuckable behind the lower frame;

wherein a first end of the lower frame is pivotably attached to a first outer end of the main axle, such that a second end of the lower frame is configured to detachably connect to a second outer end of the main axle, wherein the second end of the lower frame acts as the locking mechanism.

9. The dog waste bag dispenser device of claim 8, wherein the main frame comprises:

a) a roll opening, which is configured to receive the first dog waste bag roll; and b) an elongated opening, which is positioned below the roll opening, such that the outer end of the first dog waste bag roll is insertable through the elongated opening;

such that the dog waste bags are dispensable through the elongated opening.

10. The dog waste bag dispenser device of claim 8, further comprising:

a) an attachment ring, which is configured to attach the dog waste bag dispenser device to an article of clothing or object; and b) an attachment structure, which protrudes from an upper surface of the main frame, such that the attachment structure comprises an attachment aperture, which protrudes through the attachment structure;

wherein the attachment ring is inserted through the attachment aperture.

11. The dog waste bag dispenser device of claim 8, further comprising:

a bag clip, which is connected to the lower frame, such that the bag clip comprises a slit, which is open in a top of the slit and closed in a bottom of the slit;

such that an upper end of a used dog waste bag on an inner side of a top knotted end of the used dog waste bag is insertable through an open entrance of the slit, such that the used dog waste bag slides down and is securely positioned in a bottom of the slit.

12. The dog waste bag dispenser device of claim 11, wherein a first end of the bag clip further comprises:

an upper connector, which is connected to the lower frame;

wherein the bag clip is made from an elongated member.

13. The dog waste bag dispenser device of claim 12, wherein a first end of the bag clip is configured as a spiral of the elongated member, such that the upper connector slides onto the lower frame with the lower frame protruding through a central aperture of the spiral.

14. The dog waste bag dispenser device of claim 11, wherein the bag clip is made from an elongated member, wherein a second end of the bag clip is configured as a loop which loops back to proximity with the bag clip, in order to form a rounded outer end of the bag clip, to reduce any risk of injury or damage from contact with the second end of the bag clip.

15. The dog waste bag dispenser device of claim 8, further comprising:

a bag clip, which is connected to the main frame, such that the bag clip comprises a slit, which is open in a top of the slit and closed in a bottom of the slit;

such that an upper end of a used dog waste bag on an inner side of a top knotted end of the used dog waste bag is insertable through an open entrance of the slit, such that the used dog waste bag slides down and is securely positioned in a bottom of the slit.

16. The dog waste bag dispenser device of claim 15, wherein the slit is configured as a narrowing slit, which narrows from a top of the narrowing slit to a bottom of the narrowing slit.

17. The dog waste bag dispenser device of claim 8, wherein the dog waste bag dispenser device further comprises:

a second axle assembly, which is configured to be connected to the main frame;

wherein the main frame and the second axle assembly are configured to receive a second dog waste bag roll, which comprises a second plurality of dog waste bags, such that the dog waste bag dispenser device is configured to enable a user to easily remove a second dog waste bag from an outer end of the second dog waste bag roll;

whereby the dog waste bag dispenser device is configured to receive two dog waste bag rolls.

* * * * *